US007019702B2

(12) United States Patent
Henriet et al.

(10) Patent No.: US 7,019,702 B2
(45) Date of Patent: Mar. 28, 2006

(54) PORTABLE OBJECT COMPRISING A WRISTBAND PROVIDED WITH ELECTRICAL CONNECTION MEANS THROUGH THE CASE, ELECTRICAL CONTACT FLANGE FOR SAID OBJECT, AND MOUNTING METHOD FOR SAID FLANGE

(75) Inventors: Fabien Henriet, Courtételle (CH); Pierre-André Noirjean, Develier (CH); François Simond, Bevaix (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 15 days.

(21) Appl. No.: 10/928,147

(22) Filed: Aug. 30, 2004

(65) Prior Publication Data

US 2005/0048804 A1 Mar. 3, 2005

(30) Foreign Application Priority Data

Sep. 3, 2003 (EP) ..... 03020024

(51) Int. Cl.
*H01Q 1/12* (2006.01)

(52) U.S. Cl. ..... 343/718; 343/906; 439/37

(58) Field of Classification Search ..... 343/718, 343/906, 866, 742; 439/37; H01Q 1/12
See application file for complete search history.

(56) References Cited

U.S. PATENT DOCUMENTS

| | | | | |
|---|---|---|---|---|
| 4,947,179 | A | 8/1990 | Ganter et al. | |
| 5,168,281 | A | 12/1992 | Tokunaga | |
| 5,450,091 | A | 9/1995 | Hama | |
| 5,526,006 | A | 6/1996 | Akahane et al. | |
| 5,532,705 | A * | 7/1996 | Hama | 343/718 |
| 5,986,566 | A * | 11/1999 | Yamamori | 340/7.63 |
| 6,329,903 | B1 * | 12/2001 | Yamamori | 340/7.63 |
| 6,366,250 | B1 * | 4/2002 | McConnell | 343/718 |

FOREIGN PATENT DOCUMENTS

EP 631 341 A1 6/1994

* cited by examiner

*Primary Examiner*—Hoanganh Le
(74) *Attorney, Agent, or Firm*—Sughrue Mion, PLLC

(57) ABSTRACT

The portable object (1) comprises a case (2, 3) containing at least one electronic circuit (11), a wristband (4, 5) attached to the case, and electrical connection means (8) for electrically connecting at least one conductive track (6, 7) of the wristband to at least one contact terminal of the electronic circuit. The electrical connection means comprise at least one electrical contact flange (8) fixed through a lateral wall (15) of the case. A first portion (8) of the flange is electrically connected to the electronic circuit (11) and a second portion of the flange being electrically connected to the conductive track of the wristband. The lateral wall (15) comprises a cavity between first and second portions of the lateral wall. An opening through which the flange passes is formed in each lateral wall portion. An encapsulation material (9), such as a polymerisable adhesive, is placed in the cavity between the two wall portions to fix an intermediate portion of the flange and to shut off and seal each opening in the wall portions.

15 Claims, 4 Drawing Sheets

PORTABLE OBJECT COMPRISING A WRISTBAND PROVIDED WITH ELECTRICAL CONNECTION MEANS THROUGH THE CASE, ELECTRICAL CONTACT FLANGE FOR SAID OBJECT, AND MOUNTING METHOD FOR SAID FLANGE

This application claims priority from European Patent Application No 03020024.0 filed Sep. 3, 2003, the entire disclosure of which is incorporated herein by reference

FIELD OF THE INVENTION

The present invention relates generally to a portable object comprising a wristband with electrical connection means through the case. The portable object essentially comprises the case, containing at least one electronic circuit, a wristband attached to the case, and electrical connection means for electrically connecting at least one conductive track of the wristband to at least one contact terminal of the electronic circuit.

The present invention also relates to an electrical contact flange for a portable object comprising a wristband.

The present invention further relates to a mounting method, in particular of an electrical contact flange for a portable object having a wristband.

In the present description, the expression "electrical connection means" denotes any conductor or set of conductors for making an electrical connection between at least one contact terminal of an electronic circuit and at least one conductive track disposed in the wristband. The conductive track may constitute an antenna for transmitting and receiving signals or electrically connect an electrical component contained in the wristband and the electronic circuit in the case.

In a preferred embodiment, the portable object takes the form of a portable electronic instrument in the shape of a wristwatch. The wristwatch may comprise means for receiving or transmitting radio signals if the conductive track of the wristband constitutes an antenna. In this case, the electronic circuit for processing electrical signals controls the transmission or reception of information signals via the antenna.

BACKGROUND OF THE INVENTION

Portable objects of the above kind that are provided with electrical connection means between an electronic circuit in the case of the object and an antenna in the wristband have already been described in the prior art.

European Patent No. 0 631 341 describes a wristwatch type electronic instrument including an antenna accommodated in the wristband and connected to an electronic circuit for processing signals received via the antenna. The processing electronic circuit is on a printed circuit board inside the case of the instrument. Connection lands are provided on an edge region of the printed circuit board for making an electrical connection between the electronic circuit for processing signals and the connection terminals of the antenna, which pass through a lateral wall of the case. In a first embodiment, fixing screws pass through appropriate openings in the antenna terminals and screw directly into the printed circuit board at the location of the connection lands to make the electrical connection.

A second embodiment uses a leaf-spring connection for each terminal of the antenna that is fixed to the printed circuit board and on which an electrical conductor connected to one of the terminals of the antenna presses. Each conductor connected to a terminal of the antenna must pass through the lateral wall in order to press on the leaf-spring to make electrical contact. An O-ring is provided around said conductor where it passes through the lateral wall.

A drawback of the electronic instrument described in European Patent No. 0 631 341 is that a portion of the antenna has to pass through a lateral wall of the case in order to be connected directly to the printed circuit board. Because of this, and because of manipulations of the wristband, a permanent seal at the lateral wall of the case cannot be guaranteed, even using an O-ring.

Another drawback of the first embodiment using fixing screws is that subsequent replacement of the antenna in the event of a problem makes it essential to demount the case of the instrument completely before obtaining access to the fixing screws, which may make this operation tiresome.

Another drawback of the second embodiment using a leaf-spring is that the spring is typically soldered to the printed circuit. This must be done carefully to guarantee sufficient mechanical strength in relation to perpendicular stresses exerted on the spring when the electrical conductor presses on it. It may further be noted that the contact surfaces between the blade and the electrical conductor are not protected, which may lead to problems with the stability of the electrical connection, in particular because of possible oxidation of the exposed metal surfaces. What is more, this solution is relatively bulky and consequently is not suitable for producing a compact instrument.

U.S. Pat. No. 5,168,281 describes an antenna connection device for electronic equipment such as a wristwatch. An antenna end housed in one portion of the wristband is firmly fixed to an electrical conductor. This conductor passes through a lateral wall of the case to be connected to a contact blade of a printed circuit board carrying an electronic circuit. An O-ring is provided around the conductor where it passes through the lateral wall.

As in the previous document, a drawback of the solution proposed in U.S. Pat. No. 5,168,281 is that the antenna conductor has to pass through a lateral wall of the case in order to be connected to the contact blade on the printed circuit board. Because of this, and because of manipulations of the wristband, a permanent seal at the lateral wall of the case cannot be guaranteed, even using an O-ring.

SUMMARY OF THE INVENTION

Thus a main object of the invention is to alleviate the drawbacks of the prior art by providing a portable object comprising a wristband provided with electrical connection means passing through a lateral wall of the case in a sealed manner without being disturbed by diverse manipulations of the wristband in particular.

To this end, the invention provides a portable object of the above kind characterised in that the electrical connection means comprise at least one electrical contact flange fixed through a lateral wall of the case, a first portion of the flange inside the case being electrically connected to the electronic circuit and a second portion of the flange outside the case being electrically connected to the conductive track of the wristband, in that the lateral wall comprises a cavity between first and second portions of the lateral wall, an opening through which the flange passes being formed in each lateral wall portion, and in that an encapsulation material is placed in the cavity between the two wall portions to fix an intermediate portion of the flange and to shut off and seal each opening in the wall portions.

The portable object of the invention having a wristband has the advantage that the intermediate portion of each flange is fixed by an encapsulation material introduced into a cavity formed between first and second portions of the lateral wall. The encapsulation material in the cavity entirely surrounds the flange, which may be a metal blade, and blocks the open ends of the passage for said flange. The encapsulation material is different from the insulative material used for the lateral wall. In this way, because the properties of the encapsulation material are not modified over time in the same way as those of the material of the lateral wall, the passage of said flange through the lateral wall remains sealed. Of course, moulding the contact flange directly into the hard plastic lateral wall might have been envisaged, but sealing problems would arise in the long term, in particular with a flange in the form of a metal blade.

The encapsulation material is preferably a silicone or polymerisable adhesive that sets at room temperature over a time period that may be of the order of 24 hours.

The first portion of the metal flange, which is inside the case, is advantageously S-shaped to constitute a compression spring. When an upper portion of the case is fixed to a lower portion constituting a back of the case and carrying the lateral wall, a printed circuit board carrying the electronic circuit compresses the first portion of the flange at the level of a contact land on said board. Improved electrical contact is therefore assured, because the first portion of the compressed flange exerts a contact force against the contact land on said board.

The second portion of the metallic flange in the form of a blade is disposed over an upper surface of a mounting rim of the wristband in a rest position, i.e. before the electrical connection is made to the conductive track of the wristband. This second portion includes a hole through which a metal connection screw may be passed and screwed into a hole provided in the rim. The end of the conductive track also comprises a hole through which a metal screw may be passed. In this way, the end of the conductive track and the second portion of the flange may be fixed one on top of the other against the upper surface of the rim by inserting a screw into each of the holes and screwing it into the hole in the rim.

Note that each hole in the plastic rim may be an initially untapped hole which is tapped by screwing in a self-tapping connection screw the first time.

In a preferred embodiment of the present invention, the portable object is a wristwatch including radio communication means. Thus an antenna which consists of the conductive track is housed in the wristband. The antenna is connected to at least one electronic circuit for processing information signals received or transmitted by the antenna.

Thanks to the features of the invention, a good and durable seal is provided for connecting the antenna to the processing electronic circuit.

Another object of the invention is to provide a contact flange for electrical connection means of a portable object adapted to alleviate the drawbacks of the prior art previously cited.

To this end, the invention also provides an electrical contact flange for a portable object, which flange is characterised in that a first portion of the flange is S-shaped and constitutes a spring adapted to be compressed to establish an electrical connection with a contact land of a printed circuit board and in that an intermediate portion and a second portion of the flange have the shape of a blade.

The invention further provides a mounting method of electrical connection means of a portable object, which method is characterised in that it comprises the steps of:

passing at least one electrical contact flange through an opening in each wall portion of a cavity formed in a lateral wall of the case so that a first portion of the flange is inside the case and adapted to be electrically connected to at least one contact terminal of an electronic circuit and a second portion of the flange is outside the case and adapted to be electrically connected to at least one conductive track of the wristband, the dimension of each opening being equal to or greater than the cross-section of each portion of the flange, filling the cavity with a liquid encapsulation material using a dedicated tool, and solidifying the encapsulation material introduced into said cavity to fix the intermediate portion of the flange and to shut off and seal each wall portion opening.

The dedicated tool for filling the cavity with the encapsulation material is advantageously guided by guide means provided in each lateral wall portion to a particular distance from the back of the cavity such that it remains below each flange passing through said cavity. Filling said cavity in this way avoids the creation of air bubbles under the flanges, which could lead to failure to guarantee a good seal when the encapsulation material has set. As the cavity is formed in the lateral wall in the vertical direction, starting from an upper edge of said wall, the back of the case carrying this lateral wall may be placed on an appropriate fixture in order to offer up the dedicated tool from above to fill the cavity. In addition to positioning the tool at a certain distance from the back of the cavity, this allows the liquid encapsulation material to cover all the interior surfaces of the cavity simply through the effect of gravity.

The objects, advantages and features of the portable object having a wristband, the contact flange and the mounting method of the electrical connection means of the portable object will become more clearly apparent in the course of the following description of an embodiment of the invention, which description is given with reference to the drawings, in which:

DETAILED DESCRIPTION OF THE INVENTION

In the following description, components of the portable object that are well known to the person skilled in the art in this technical field are not explained in detail. The embodiment described relates specifically to a portable object which, by way of non-limiting example, takes the form of a wristwatch with radio receiving or transmitting functions. Note that all the components of the wristwatch described hereinafter with reference to FIGS. 1 to 5 have identical reference numbers. Accordingly, for simplicity, the description of each item is not repeated in respect of all the figures.

Figure 1A:
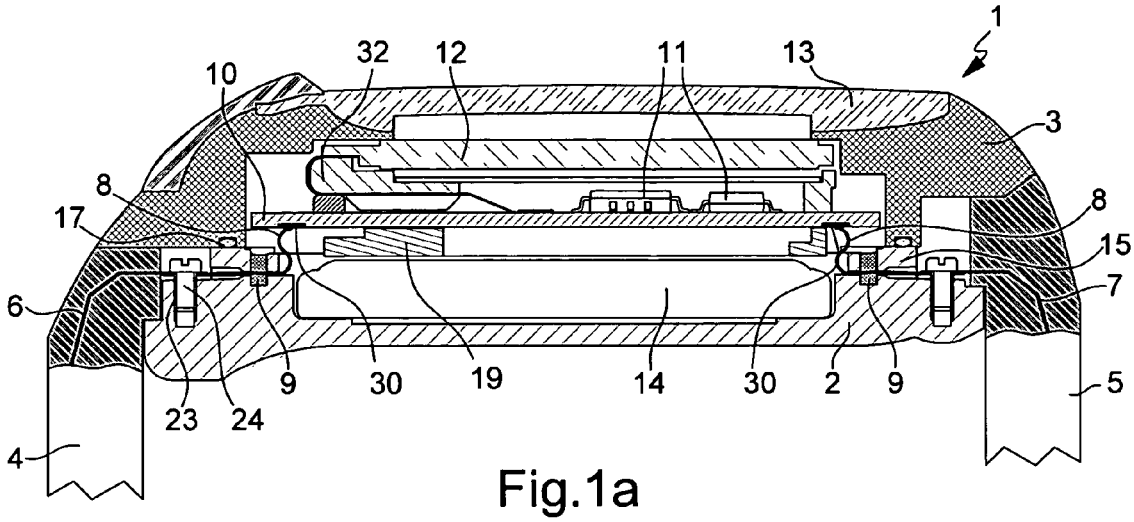
FIGS. 1*a* and 1*b* respectively represent a view of the portable object of the invention in partial section and a plan view of the back of the case showing the lateral wall and the contact flanges, but with no encapsulation material, FIGS. 2*a* and 2*b* respectively represent a three-dimensional view of the back showing the lateral wall, the contact flanges and two portions of the wristband resting on a mounting rim, and an exploded three-dimensional partial view showing the fixing of the ends of the conductive track of the wristband and the contact flanges to the rim of the back.

FIG. 1*a* represents a diagrammatic sectional view of a portable object in the form of a wristwatch 1. The wristwatch 1 comprises a case having an upper portion 3 called the bezel and a lower portion 2 called the back, a wristband with two portions 4 and 5 attached to the case, and at least one control button or crown, not shown. The upper portion 3 and the lower portion 2 are assembled together and to one of the ends of each wristband portion 4 and 5 in a closed position of the case by conventional fixing means that are not shown in FIG. 1*a*. Said ends of the wristband portions 4 and 5 are clamped between the back 2 and the bezel 3. An O-ring 17 in an annular groove in the bezel comes into contact with an upper edge of a lateral wall 15 of the back 2 to seal the closed case. The top of the case is closed by a watchglass 13 of conventional type and made from plastic or sapphire, according to the intended price range.

The case of the wristwatch 1 contains a battery or accumulator 14 in a housing in the back 2 of the case, the printed circuit board 10, on which is mounted at least one electronic circuit 11 supplied with power by the battery, and a liquid crystal display (LCD) 12 for displaying in particular time, text or other functions. The display 12 is controlled by the electronic circuit 11. Electrically conductive tracks, not shown, on the printed circuit board electrically connect electrical contact lands 30 at the edge of said board to terminals of the electronic circuit 11.

A spacer 32 is disposed between the LCD 12 and the printed circuit board 10 to ensure a sufficient distance between these members and to provide space for components, such as the electronic circuit 11 shown in the resulting space.

Figure 1B:
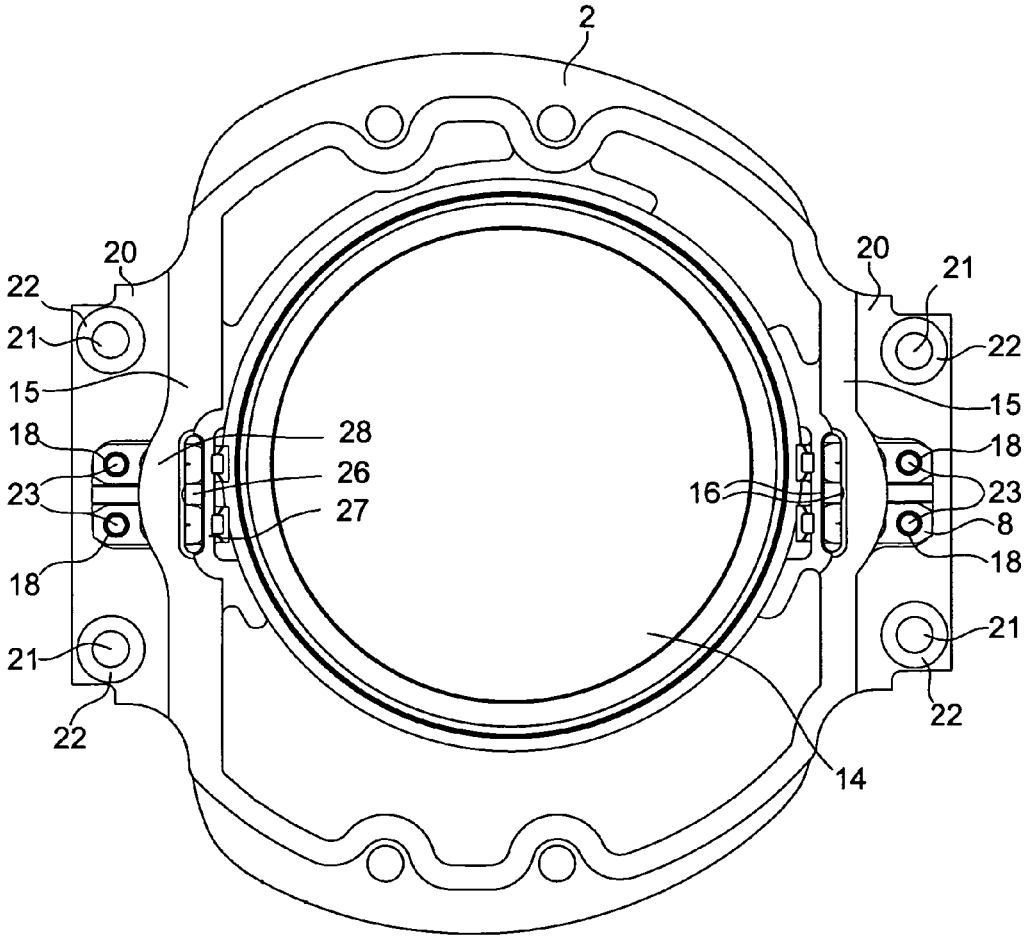

According to the invention, the wristwatch also comprises electrical connection means that include in particular electrical contact flanges 8, of which there are four in this embodiment, as shown in FIG. 1*b* in particular.

Referring to FIG. 1*a*, the flanges 8 are adapted to make electrical contact with the contact lands 30 on the printed circuit board 10 and with the end of at least one conductive track 6 and 7 in each wristband portion 4 and 5. The conductive track 6 and 7 of each wristband portion preferably constitutes an antenna co-operating with the electronic circuit to transmit and receive information. To this end, the electronic circuit 11, which is inside the case of the watch 1, comprises an information processing unit.

As shown in FIG. 1*b*, the lateral wall 15 comprises two cavities 26 formed in a vertical direction and starting from an upper edge of said wall to define a back, an interior first portion 27 and an exterior second portion 28 of the wall 15. These cavities are diametrically opposed in the lateral wall 15 and situated at the level of the connection of each end of the wristband portions 4 and 5 to the case. Two pairs of parallel contact flanges 8 pass through openings in two wall portions 27 and 28 of the two cavities 26 in the lateral wall 15 of the back 2. The intermediate portion of each pair of flanges 8 is fixed and sealed by an encapsulation material 9, not represented in FIG. 1*b*, that is introduced into each cavity 26 in the manner described hereinafter and with reference to FIGS. 3*a* and 3*b* in particular.

The encapsulation material is preferably a silicone or polymerisable adhesive. The encapsulation material 9 is different from the insulative plastic material used for the lateral wall 15 in particular. As a result, because the properties of the encapsulation material are not modified over time in the same way as the lateral wall, which is made of hard plastic, for example, the passage of said flange 8 through the lateral wall 15 remains sealed.

Figure 4:
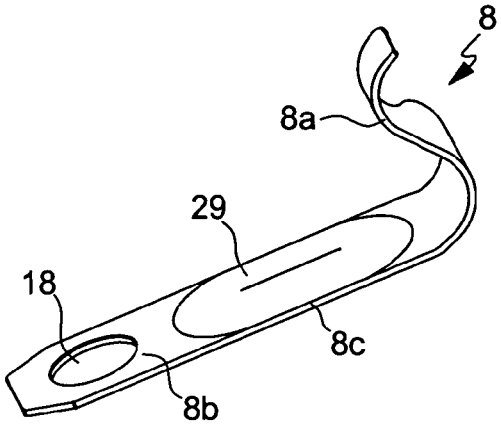
FIG. 4 represents a three-dimensional view of a contact flange used in the portable object according to the invention, and FIGS. 5*a* and 5*b* respectively represent a side view and a view in section taken along the line A—A in FIG. 5*a* of the contact flange of a portable object according to the invention.
Figure 5A:
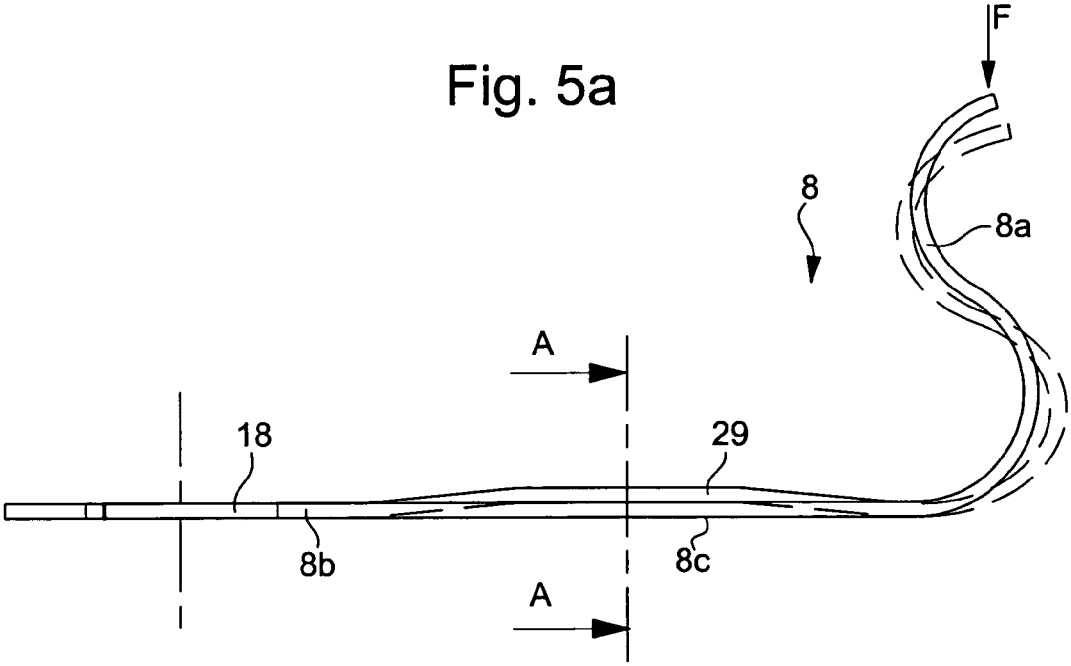
Figure 5B:
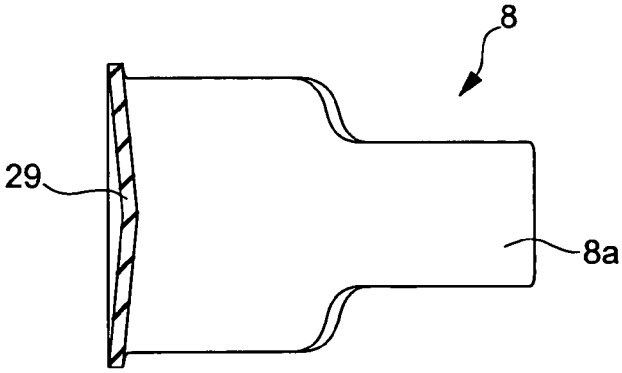

The electrical contact flange 8 used as electrical connection means is shown more clearly in FIG. 4, which represents a three-dimensional view of the flange, and in FIGS. 5*a* and 5*b*. The contact flange 8 is made from a strip of a metal that is a good conductor of electricity, such as a copper alloy. The thickness of this strip may be of the order of 0.1 mm.

Referring to FIGS. 4 and 5*a*, the flange has an S-shaped first portion 8*a*, a second portion 8*b* and an intermediate portion 8*c* that is adapted to be fixed in position through the lateral wall of the back of the case by the encapsulation material.

The S-shaped first portion 8*a* of the flange 8 constitutes a compression spring. When the case is closed, the printed circuit board compresses each first portion of a flange 8 at the level of the contact lands of the printed circuit board with a particular force F. This makes good electrical contact between the flange and the corresponding contact land. The first portion 8*a* of the flange 8 when compressed in this way is shown in chain-dotted line in FIG. 5*a*.

As shown in FIG. 1*a*, the printed circuit board 10 rests on a spacer 19 separating it from the battery 14. This also prevents unnecessary damage to the first portion of each flange 8 when closing the case.

Referring to FIGS. 4 and 5*a*, the intermediate portion 8*c* and the second portion 8*b* of the flange have the general shape of a blade. The second portion 8*b* of the flange has a hole 18 through it so that it may be fixed to one end of a conductive track as explained hereinafter. Also, the end of the second portion 8*b* of the flange is tapered to facilitate passing the flange through the openings in the wall portions accommodating it before fixing it by means of the encapsulation material.

A drawn or stamped boss 29 may be formed in the intermediate portion 8*c* of the flanges to locate them in the openings formed in each lateral wall portion. Each opening in said wall portions is therefore formed with sufficient dimensions to facilitate the introduction of the second flange portion. The height of each opening may be 0.2 mm, for example, and the thickness of the second flange portion may be 0.1 mm. On the other hand, the height of the boss may be substantially equal to the height of each opening, which locates the intermediate portion of the flange correctly before the encapsulation material is introduced into the cavity in the lateral wall. The width of each opening in wall portions receiving a flange may be substantially equal to or slightly greater than the width of the flange.

Figure 2A:
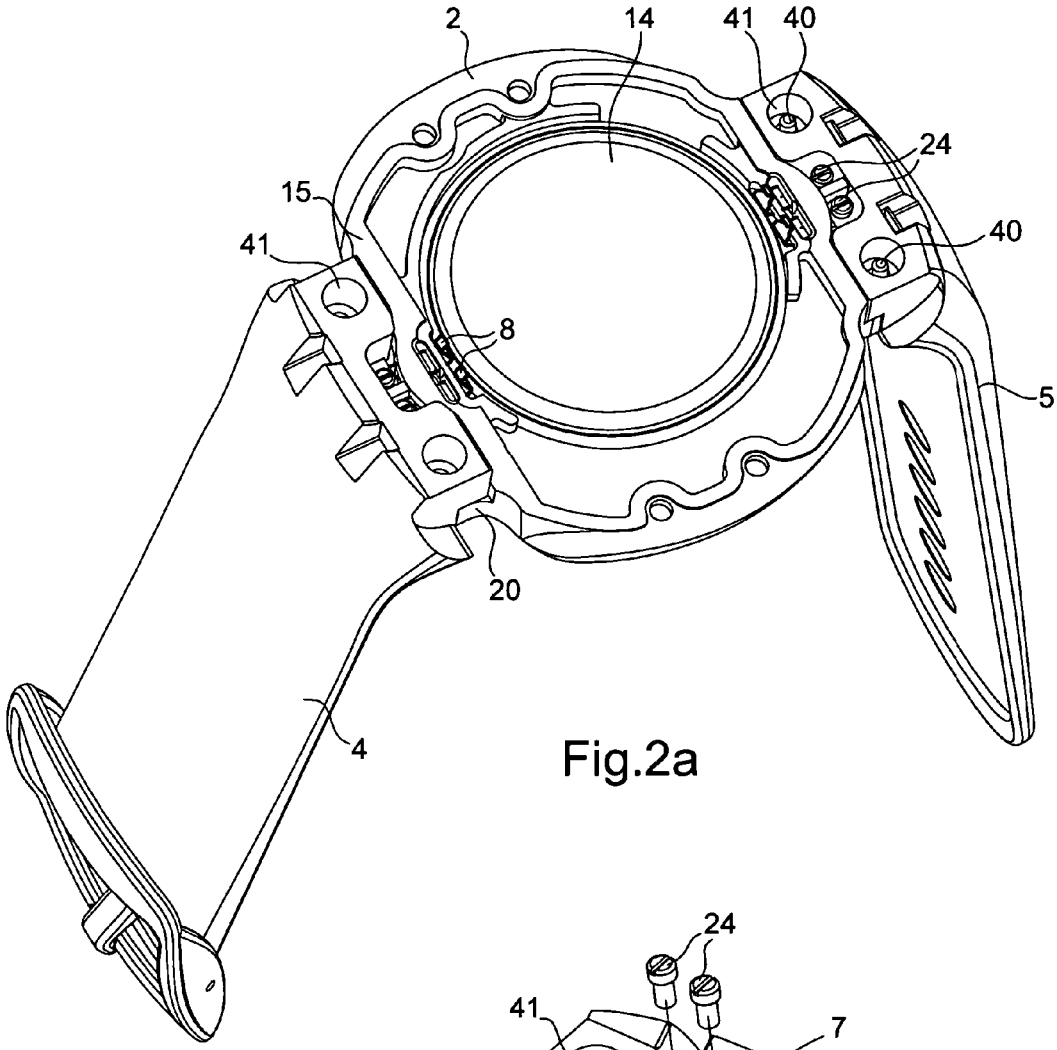
Figure 2B:
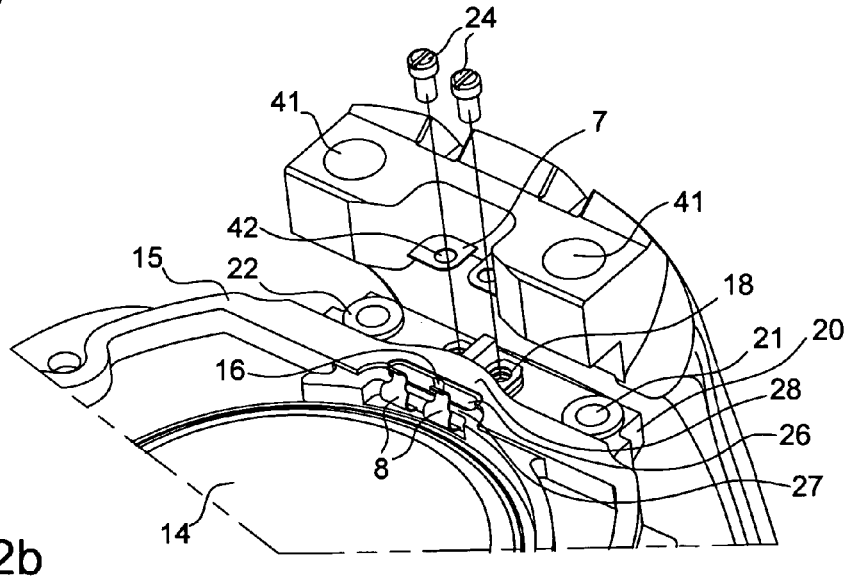

As shown in FIGS. 1*a*, 2*a* and 2*b*, the exterior second portion of each flange 8 is thus connected to a respective end of a conductive track 6 and 7 of each portion 4 and 5 of the wristband constituting in particular an antenna. This electrical connection is made by means of rods with a head, such as connecting screws 24 screwed into respective holes 23 formed in a plastic rim 20 of the back 2 and extending the lateral wall 15. Each hole may be tapped by a self-tapping connecting screw or may comprise a screwthread from the outset.

Each threaded portion of the connecting screws 24 passes through an appropriate hole 18 in the second portion of the flange 8 and an appropriate hole 42 at the end of the corresponding conductive track 6 and 7 to be connected. As the diameter of the screw head is larger than the diameter of the holes 18 and 42, the second portion of the flange and the end of the conductive track are able to come into direct contact with the upper surface of the insulative rim 20 when each connecting screw 24 is screwed all the way into its hole 23.

The fixing means that retain the upper portion 3 of the case to the lower portion 2 fix the end of each wristband portion 4 and 5 to the case between the bezel 3 and the rim 20 of the back extending the lateral wall 15.

As may be seen in FIGS. 1*b* and 2*b*, two tubular portions 22 are formed on each rim 20 to receive the corresponding end of the wristband portion to be fixed to the case. Each end of the wristband portion comprises two openings 41 of complementary shape adapted to be nested over the tubular portions 22. Fixing screws 40 shown in FIG. 2*a* pass through respective holes 21 in the tubular portions 22 and respective openings 41 in the portions of the wristband and are screwed into threaded holes in the upper portion, not shown. Thus the wristband is fixed to the case when the latter is closed.

In the event of replacement of the wristband, or at least of the wristband portions 4 and 5, it suffices to unscrew the case fixing screws 40, remove them at least from the holes 41 in the wristband portions, separate the back 2 from the bezel 3 from the case, and unscrew the connecting screws 24.

Referring to FIG. 2*b*, showing a partial exploded view of the mounting of the end of the wristband portion to the case of the watch, each end of the conductive track 7 is positioned on the second portion of the corresponding flange 8 so that the holes 18 and 42 are substantially coaxial. Once the end of the portion has been positioned correctly, the connecting screws 24 may be inserted into the holes 18 and 42 and screwed into the tapped holes in the rim 20. Because the second portion of the flange 8 is at a distance from the upper surface of the rim 20, it is able to flex elastically when the connecting screw is screwed in until it comes into contact with the upper surface of the rim. Thus a good electrical connection is established between each flange and the corresponding end of the conductive track.

The steps of the mounting method of the electrical connection means of the portable object, such as the electrical contact flanges, are described in more detail with reference to FIGS. 3*a* and 3*b*.

The back 2 of the case is first placed on and secured to a working surface. The second portion of each electrical contact flange 8, the end of which is tapered, is passed through each of the openings 31 formed in the portions 27 and 28 of the lateral wall 15. Inserting the flange is facilitated by the tapered shape of the second portion and the fact that the thickness of the blade is practically half the height of the openings 31. Said flange 8 is therefore passed through the openings 31 from inside the case until the hole 18 in the second portion is substantially coaxial with the tapped hole 23 in the rim 20. The intermediate portion of the flange is then positioned in the openings 31 of the wall portions 27 and 28 by the boss 29, whose height is substantially equal to the height of each opening 31.

As two flanges must be passed through each cavity 26 in the lateral wall, the operations indicated above are carried out either simultaneously for all of the flanges or separately for each flange 8.

As soon as the two flanges 8 have been passed through the openings 31 of one of the cavities 26, a dedicated tool 50, such as a syringe, is introduced into the cavity 26 to a certain distance from the back of the cavity, ready to introduce the liquid encapsulation material 9, such as a silicone or polymerisable adhesive. The downward movement of the dedicated tool is guided by guide means 16 that may also be seen in FIGS. 1*b*, 2*a* and 2*b*. The guide means 16 are partly formed in each portion 27 and 28 of the lateral wall and are situated between the two flanges to be fixed. The shape of the guide means is substantially complementary to that of the conical portion of the dedicated tool. This stops the downward movement of the tool into the cavity at a particular distance from the back of the cavity and each intermediate portion of the positioned flanges. The position of the dedicated tool in the cavity is shown in chain-dotted outline in FIG. 3*a*.

Figure 3A:
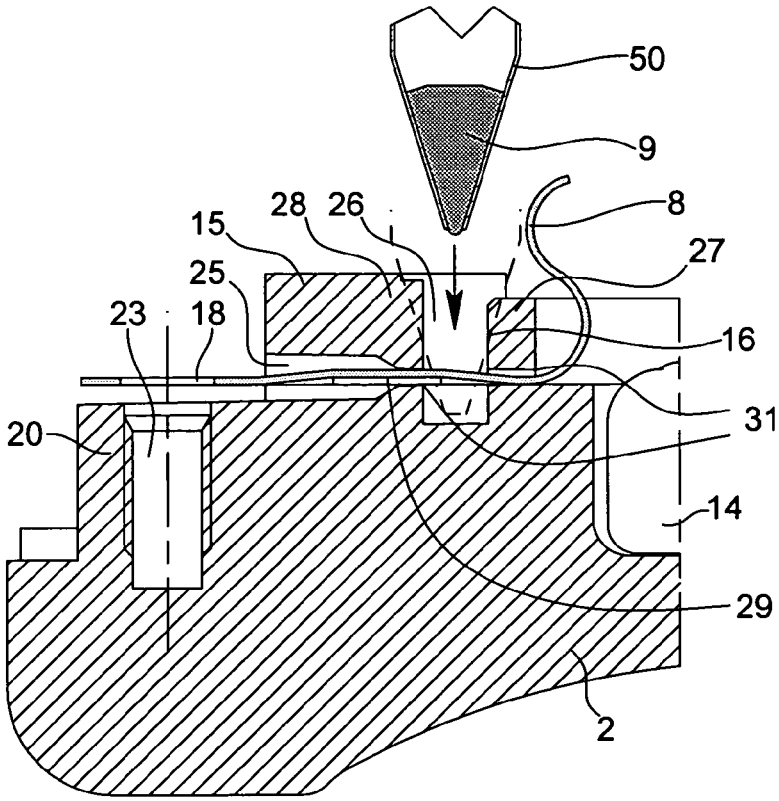
FIGS. 3*a* and 3*b* represent two steps of the mounting method of the flange of the portable object of the invention in a sectional view to a larger scale of the back of the case at the level of the cavity.

Once the dedicated tool 50 is occupying the position in the cavity 26 indicated by the chain-dotted lines in FIG. 3*a*, a particular quantity of liquid polymerisable adhesive is introduced into the cavity from the lower end of the tool. The liquid adhesive 9 spreads into the cavity 26, shutting off each opening 31 of the portions 27 and 28 without overflowing and coating the intermediate portion of the flanges 8. Introducing the adhesive from the back of the cavity prevents the generation of air bubbles in the cavity that could compromise the sealing of the flanges fixed through the lateral wall. Moreover, because of the effect of gravity, the adhesive spreads uniformly in said cavity to fill it completely.

Once the liquid adhesive has been introduced until it reaches the upper edge of the cavity 26, the tool 50 is withdrawn progressively from the cavity. The tool may introduce further adhesive whilst leaving the cavity so that the level of the adhesive introduced reaches the upper edge of the cavity 26. A certain period of time must be allowed after this for the adhesive to set, as shown in FIG. 3*b*. This time period may be of the order of 24 hours at room temperature. As the adhesive is relatively elastic, with good adhesion to the interior surfaces of the cavity 26, this encapsulates said flanges in a sealed manner in the cavity 26 of the lateral wall 15, which is one of the objects of the invention.

Figure 3B:
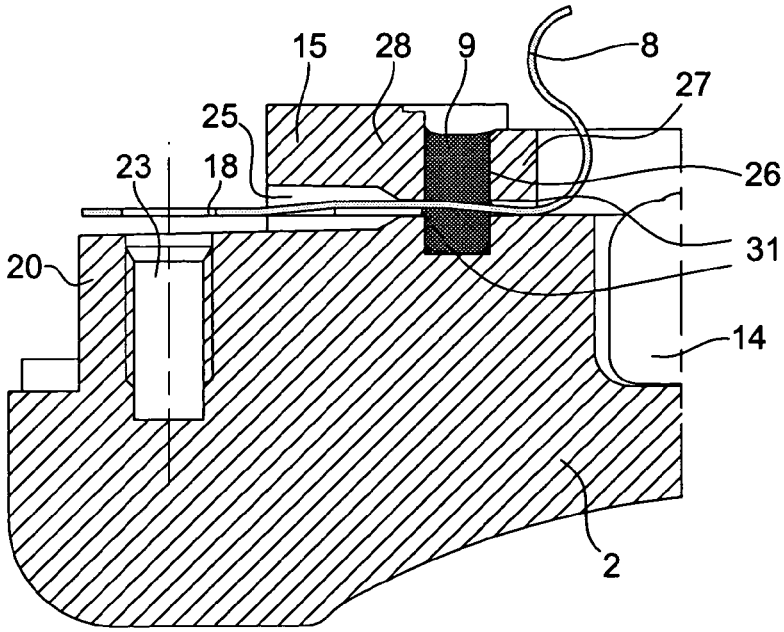

Note also that in FIGS. 3*a* and 3*b* the exterior portion 28 of the lateral wall comprises a flare 25 after the opening 31 through which the flange passes. This flare 25 allows the second portion of the flange, which is at a distance from the upper surface of the rim 20 when in its rest position, to flex without permanent deformation. In this way, this second flange portion may be fixed with one end of the conductive track of the wristband, by means of the connecting screws, until it comes into contact with the upper surface of the rim 20, as previously explained.

Once the contact flanges 8 have been fixed through the lateral walls, mounting all the components of the case and the wristband may be undertaken, in particular the printed circuit board that compresses the first portion of each flange at the level of its contact lands on closing the case.

On the basis of the foregoing description of multiple embodiments of the portable object with a wristband, the person skilled in the art will be in a position to envisage many variants that do not depart from the scope of the invention as defined by the claims. The boss on the intermediate portion of each flange may be replaced by two blisters each housed in an opening of each portion of the lateral wall. There may be only one flange per cavity for connecting each end of a single conductive track housed in the wristband.

What is claimed is:

1. A portable object comprising a case containing at least one electronic circuit, a wristband attached to the case, and electrical connection means for electrically connecting at least one conductive track of the wristband to at least one contact terminal of the electronic circuit, wherein the electrical connection means comprise at least one electrical contact flange fixed through a lateral wall of the case, a first portion of the flange inside the case being electrically connected to the electronic circuit and a second portion of the flange outside the case being electrically connected to the conductive track of the wristband, wherein the lateral wall comprises a cavity between first and second portions of the lateral wall, an opening through which the flange passes being formed in each lateral wall portion, and wherein an encapsulation material is placed in the cavity between the two wall portions to fix an intermediate portion of the flange and to shut off and seal each opening in the wall portions.

2. A portable object according to claim 1, wherein the encapsulation material is a silicone or polymerisable adhesive.

3. A portable object according to claim 1, wherein the cavity is formed from an upper edge of said wall and over a portion of its height to define a back, an interior first portion and an exterior second portion of the lateral wall.

4. A portable object according to claim 1, wherein the intermediate portion and the second portion of the metal flange are in the shape of a blade.

5. A portable object according to claim 4, wherein at least one boss obtained in particular by stamping is formed in the intermediate portion of the blade so that the height of the intermediate portion of the flange is substantially equal to that of each opening in the wall portions for positioning the flange through the lateral wall.

6. A portable object according to claim 4, wherein the case has a lower portion of insulative material serving as the back of the case carrying the lateral wall, an upper portion serving as the bezel co-operating with the lower portion, and fixing means for holding the lower and upper portions together in the closed configuration of the case, the electronic circuit being mounted on a printed circuit board that comprises at least one contact land connected to a contact terminal of the electronic circuit, wherein the first portion of the metal flange is S-shaped, constituting a spring adapted to be compressed on contact of the end of this first flange portion with a contact land of the printed circuit board in the closed configuration of the case.

7. A portable object according to claim 1, wherein at least one insulative exterior rim for mounting one end of a portion of the wristband is provided in an exterior extension of a lower portion of the case and starting from the lateral wall at the place where the intermediate portion of the flange is fixed, the exterior second portion of the flange being, in a rest position with no elastic flexing, at a distance from an upper surface of the rim, and wherein the second portion of the flange and the end of the conductive track of the wristband each comprise a hole so that they can be fixed together, in particular against the upper surface of said rim, by means of a conductive rod that is inserted into a fixing hole in said rim and has a head, the diameter of the holes in the second portion of the flange and the end of the conductive track being less than the diameter of the head of the rod and greater than the diameter of the rod.

8. A portable object according to claim 7, wherein the rod with a head is a connecting screw inserted into a hole in the rim for electrically connecting the end of the conductive track and the second portion of the flange, each hole in the rim being tapped by a self-tapping connecting screw or comprising a screw thread from the outset.

9. A portable object according to claim 1, wherein two ends of the conductive track of the wristband are connected to the electrical connection means, the conductive track of the wristband constitutes an antenna for transmitting or receiving information signals, and the electronic circuit is provided with a unit for processing signals from the antenna or transmitted by the antenna, wherein two parallel electrical contact flanges pass through a respective opening in each lateral wall portion of the case of the same cavity, a second portion of each flange being connected to a respective end of a conductive track, and wherein the encapsulation material fixes the intermediate portions of the two flanges in the same cavity between the two wall portions.

10. A portable object according to claim 1, wherein the lateral wall comprises two diametrically opposed cavities and one or two flanges per cavity are fixed by the encapsulation material placed between the first and second wall portions of each cavity, the second portion of each flange being connected to one end of a conductive track of one or two portions of the wristband, and the first portion of each flange being connected to a corresponding contact land of the printed circuit board carrying the electronic circuit.

11. An electrical contact flange for a portable object according to claim 1, wherein a first portion of the flange is S-shaped and constitutes a spring adapted to be compressed to establish an electrical connection with a contact land of a printed circuit board and wherein an intermediate portion and a second portion of the flange have the shape of a blade.

12. An electrical contact flange according to claim 11, wherein at least one boss obtained in particular by stamping is formed in the intermediate flange portion, the height of this boss being made substantially equal to the height of an opening in a lateral wall receiving the intermediate flange portion to position the flange.

13. A mounting method of electrical connection means of a portable object according to claim 1, the connecting means comprising at least one electrical contact flange, wherein the method comprises the steps of:

passing at least one electrical contact flange through an opening in each wall portion of a cavity formed in a lateral wall of the case so that a first portion of the flange is inside the case and adapted to be electrically connected to at least one contact terminal of an electronic circuit and a second portion of the flange is outside the case and adapted to be electrically connected to at least one conductive track of the wristband, the dimension of each opening being equal to or greater than the cross-section of each portion of the flange, filling the cavity with a liquid encapsulation material using a dedicated tool, and solidifying the encapsulation material introduced into said cavity to fix the intermediate portion of the flange and to shut off and seal each wall portion opening.

14. A method according to claim 13, wherein the cavity is filled with an encapsulation material that consists of a silicone or polymerisable adhesive.

15. A method according to claim 13, wherein the lateral wall forms part of the back of the case and the cavity is formed in the vertical direction, starting from the upper edge of said lateral wall, in order to be delimited by the two wall portions, wherein a dedicated tool for filling it with the embedded material is inserted into said cavity, being guided by guide means formed in each wall portion to a particular distance from the back of the cavity, the guide means being of complementary shape to the tool, so as to fill said cavity with a particular quantity of the encapsulation material from its back below the intermediate portion of the flange as far as the vicinity of the upper edge of each wall portion.

* * * * *